US005502625A

United States Patent [19]

Peng

[11] Patent Number: 5,502,625

[45] Date of Patent: Mar. 26, 1996

[54] MULTIPURPOSE HAND TOOL

[76] Inventor: Ming-Yi Peng, No. 9, Lane 28, Chang Shou Street, Su Lin Chen, Taipei Hsien, Taiwan

[21] Appl. No.: 516,070

[22] Filed: Aug. 17, 1995

[51] Int. Cl.[6] ..... B25B 23/18

[52] U.S. Cl. ..... 362/119; 362/120

[58] Field of Search ..... 362/102, 119, 362/120, 109, 205, 208, 190, 186, 187

[56] References Cited

U.S. PATENT DOCUMENTS

| | | | |
|---|---|---|---|
| 1,135,297 | 1/1915 | La Combe, Jr. | 362/119 |
| 2,341,375 | 2/1994 | Hambleton | 362/119 |
| 4,252,134 | 2/1981 | Barnaby | 362/119 |
| 5,051,876 | 9/1991 | Norman | 362/120 |
| 5,168,780 | 12/1992 | Van Gennep | 362/119 |
| 5,363,285 | 11/1994 | Wideman | 362/102 |

*Primary Examiner*—James C. Yueng
*Attorney, Agent, or Firm*—Varndell Legal Group

[57] ABSTRACT

A multipurpose hand tool including a spanner, which consists of a box-end vertical rod and a transverse tube, an illuminator mounted in the transverse tube of the spanner and controlled by a lamp cover, which is threaded onto one end of the transverse tube to hold down the lamp bulb of the illuminator, and a screwdriver, which when not in use is mounted in one end of the transverse tube and stopped against the illuminator.

2 Claims, 4 Drawing Sheets

MULTIPURPOSE HAND TOOL

BACKGROUND AND SUMMARY OF THE INVENTION

The present invention relates to hand tools, and relates more particularly to a multipurpose hand tool which combines a spanner, a screwdriver, and an illuminator together.

Various hand tools have been disclosed for different purposes, and have appeard on the market. Screwdrivers and spanners are most commonly used hand tools for turning screws, bolts, nuts, etc. These hand tools are requisite for car drivers. Furthermore, when using a hand tool in a dark place, an illuminator is needed. However, when a variety of hand tools are prepared, much storage space is required.

The present invention has been accomplished to provide a multipurpose hand tool which combines a spanner, a screwdriver, and an illuminator together.

According to one aspect of the present invention, the multipurpose hand tools comprises a spanner, which consists of a box-end vertical rod and a transverse tube intersecting one end of the box-end vertical rod, an illuminator mounted in the transverse tube of the spanner and controlled by a lamp cover, which is threaded onto one end of the transverse tube to hold down the lamp bulb of the illuminator, and a screwdriver, which when not in use is mounted in one end of the transverse tube and stopped against the illuminator. According to another aspect of the present invention, the screwdriver comprises a head, and a blade fastened to the head by a chuck sleeve and having a keystone tip and a Phillips head tip at both ends.

DETAILED DESCRIPTION OF THE PREFERRED EMBODIMENT

Referring to Figures from 1 to 4, a multipurpose hand tool in accordance with the present invention is generally comprised of a screwdriver 1, an illuminator 2, and a spanner unit 3.

Figure 2:
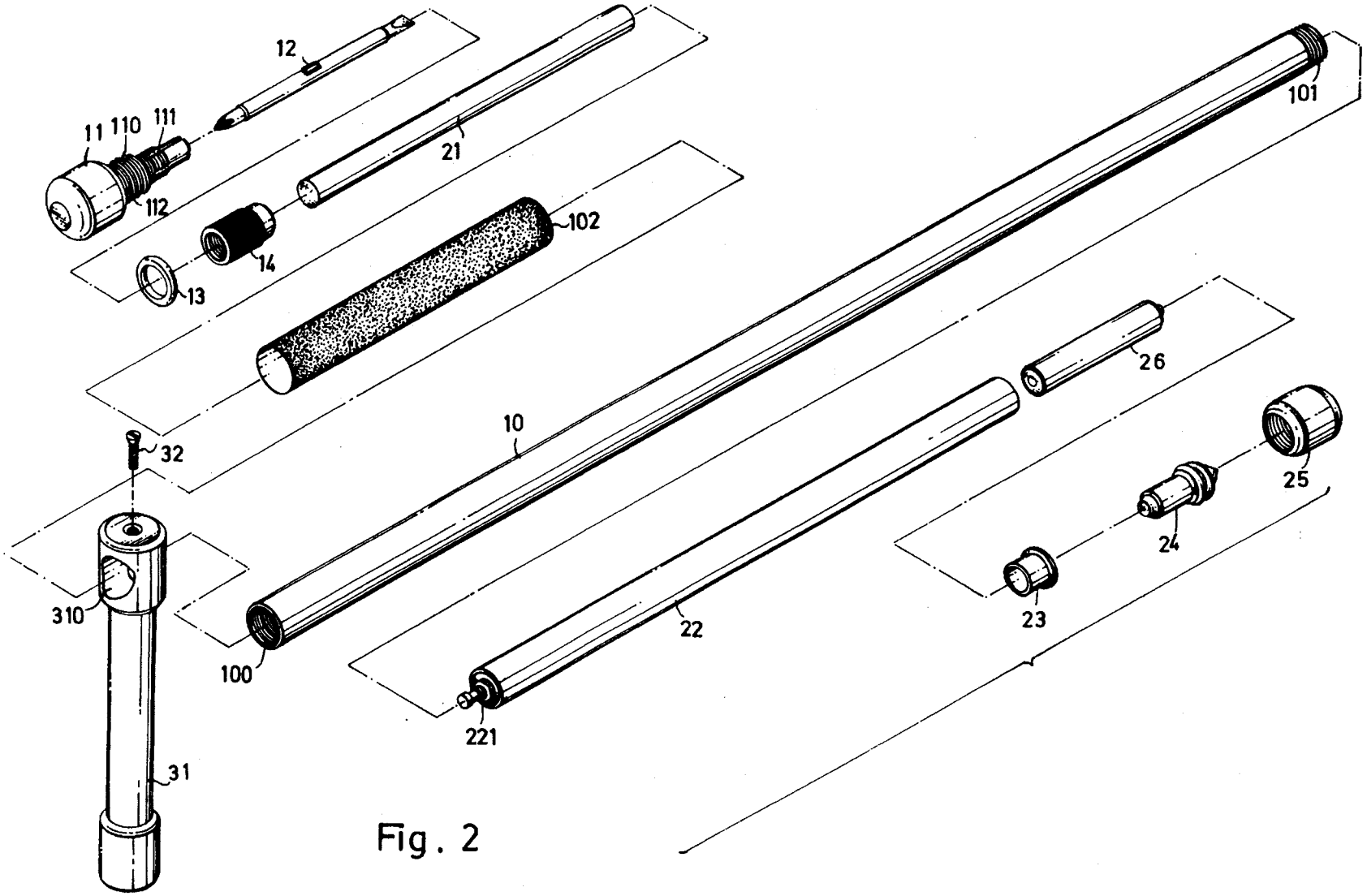
FIG. 2 is an exploded view of the multipurpose hand tool shown in FIG. 1.
Figure 3:
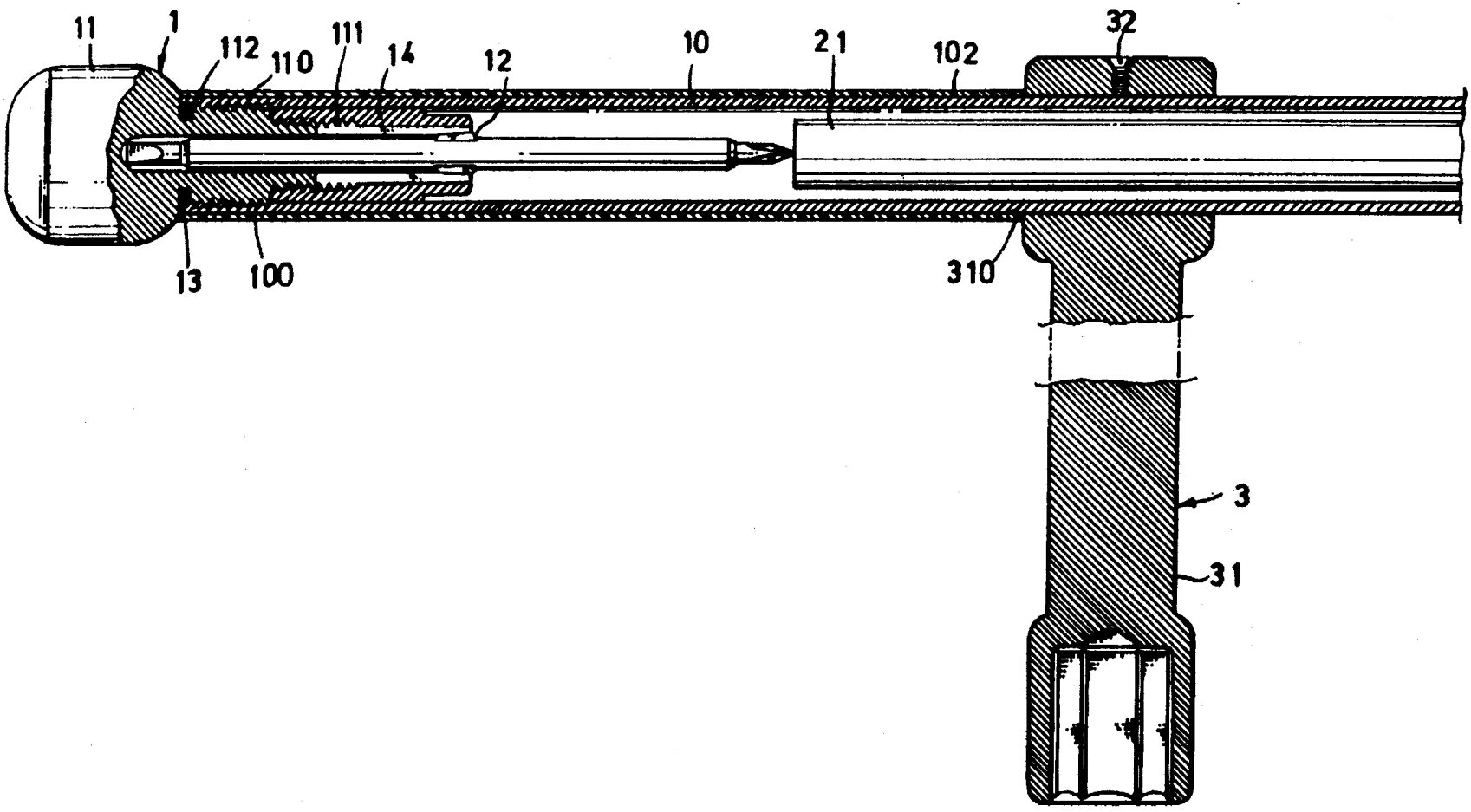
FIG. 3 is a sectional view in an enlarged scale of the left part of FIG. 1, showing the screwdriver mounted in one end of the transverse tube of the spanner.

Referring to FIGS. 2 and 3 again, the screwdriver 1 comprises a head 11, a blade 12, a rubber ring 13, and a chuck sleeve 14. The head 11 comprises an annular groove 112 around the periphery, a threaded coupling poprtion 111, and an outer thread 110 between the coupling portion 111 and the annular groove 112. The rubber ring 13 is mounted around the annular groove 112. The chuck sleeve 14 is fastened to the threaded coupling portion 111 to hold the blade 12. The blade 12 has one end terminating in a keystone tip and an opposite end terminating in a Phillips head tip.

Figure 1:
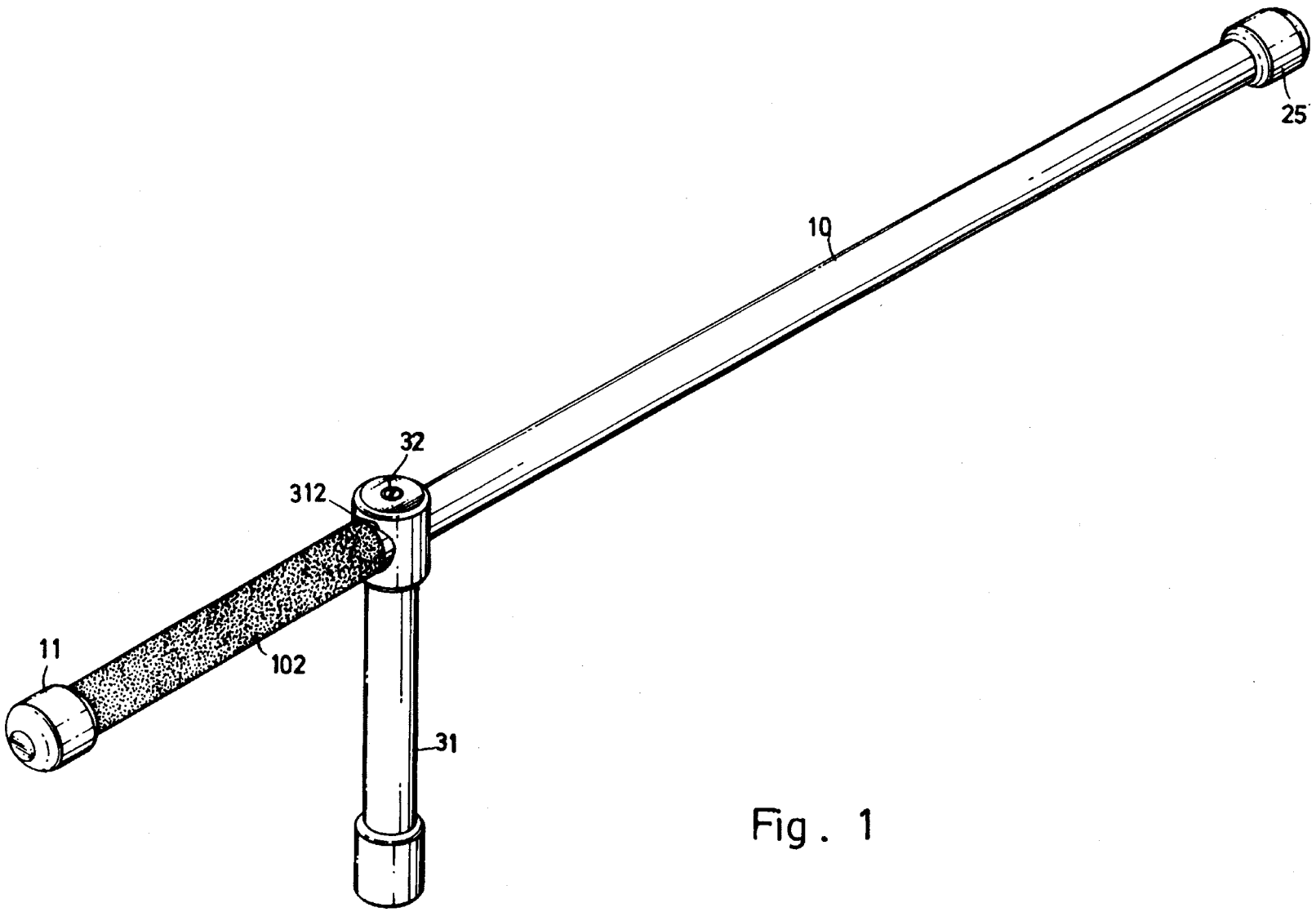
FIG. 1 is an elevational view of a multipurpose hand tool according to the present invention.

Referring to FIGS. 1, 2, and 3 again, the spanner 3 comprises a box-end vertical rod 31 having a transverse coupling hole 310 at one end, a transverse tube 10 inserted through the transverse coupling hole 310 of the box-end vertical rod 31 and then fixed in place by a tightening up screw 32, and a rubber covering 102 mounted around the transverse tube 10. The transverse tube 10 has an inner thread 100 at one end and an outer thread 101 at an opposite end. When the screwdriver I is not in use, it is mounted in the spanner 3 by inserting the blade 12 with the chuck sleeve 14 into the transverse tube 10 and then threading the outer thread 110 of the head 11 into the inner thread 100 (see FIG. 3).

Figure 4:
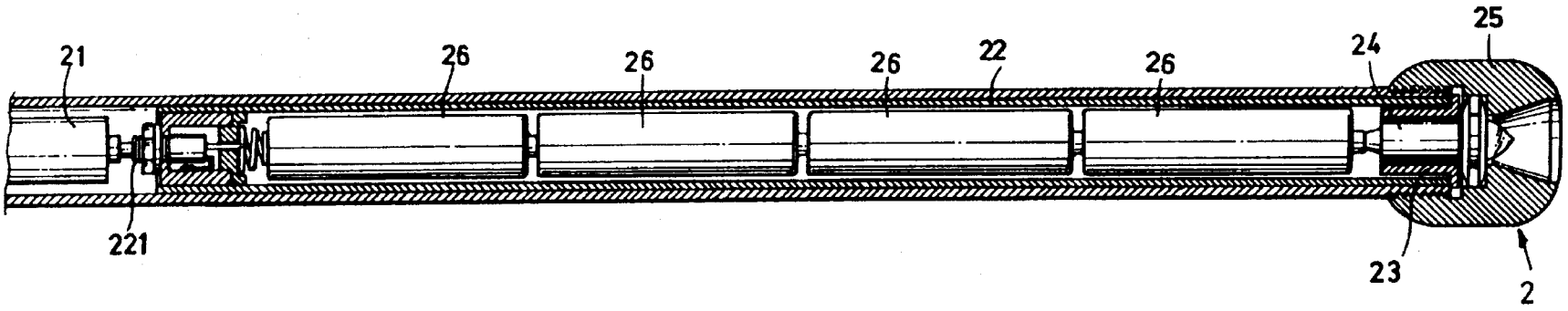
FIG. 4 is a sectional view in an enlarged scale of the right part of FIG. 1, showing the illuminator mounted in one end of the transverse tube of the spanner.

Referring to FIGS. 1, 2, and 4 again, the illuminator 2 comprises a stop rod 21 insertred into the transverse tube 10 and stopped against the blade 12 of the screwdriver 1, a cylindrical battery case 22 inserted into the transverse tube 10 and having a press-button switch 221 at one end stopped against the stop rod 21, a set of battery cells 26 counted in the cylindrical battery case 22, a socket 23 fastened to the cylindrical battery case 22 at one end remote from the press-button switch 221, a lamp bulb 24 fastened to the socket 23 and connected to the battery cells 26, and a lamp cover 25 threaded onto the outer thread 101 of the transverse tube 10 to hold the lamp bulb 24 on the inside. When the lamp cover 25 is fastened tight the press-button switch 221 is forced against the stop rod 21 and swtiched on, and therefore the lamp bulb 24 is turned on. When the lamp cover 25 is loosened from outer thread 101 of the transverse tube 10, the press-button switch 221 is released from the stop rod 21 and switched off, and therefore the lamp bulb 24 is turned off.

Furthermore, the head 11, the transverse tube 10, the vertical rod 31, and the lamp cover 25 are smoothly surface treated without having any acute angle. Therefore, the multipurpose hand tool does not hurt when operated with hand.

I claim:

1. A multipurpose hand tool comprising a spanner, a screwdriver, and an illuminator, wherein:

said spanner comprises a box-end vertical rod having a box end at one end and a transverse coupling hole at an opposite end, and a transverse tube covered with a rubber covering and fastened to the transverse coupling hole of said box-end vertical rod by a tightening up screw, said transverse tube having an outer thread at one end and an inner thread at an opposite end;

said screwdriver comprises a head, a blade, a rubber ring, and a chuck sleeve, said head comprising an annular groove around the periphery, a threaded coupling portion, which receives said blade, and an outer thread between said threaded coupling portion and said annular groove for threading into the inner thread of said transverse tube, said rubber ring being mounted around the annular groove of said head, said chuck sleeve being fastened to said threaded coupling portion to hold down said blade, said blade having a keystone tip at one end and a Phillips head tip at an opposite end;

said illuminator comprises a stop rod inserted into said transverse tube and stopped against the blade of said screwdriver, a cylindrical battery case inserted into said transverse tube and having a press-button switch at one end stopped against said stop rod, a set of battery cells mounted in said cylindrical battery case, a socket fastened to said cylindrical battery case at one end remote from said press-button switch, a lamp bulb fastened to said socket and connected said battery cells, and a lamp cover threaded onto the outer thread of said transverse tube to hold said lamp bulb on the inside and turned relative to said transverse tube to turn on/off said lamp bulb.

2. The multipurpose hand tool of claim 1 wherein the head of said screwdriver, the transverse and vertical rod of said spanner, and the lamp cover of said illuminator are smoothly surface treated without having any acute angle.

* * * * *